US005320567A

United States Patent [19]

Beer

[11] Patent Number: 5,320,567

[45] Date of Patent: Jun. 14, 1994

[54] AQUATIC RESCUE DEVICE

[75] Inventor: Robert C. Beer, Spencer, Mass.

[73] Assignee: Angel Guard Products, Inc., Worcester, Mass.

[21] Appl. No.: 84,803

[22] Filed: Jun. 29, 1993

[51] Int. Cl.[5] ..... B63C 9/32

[52] U.S. Cl. ..... 441/82; 114/61; 114/283; 280/12.11

[58] Field of Search ..... 441/73, 80, 82; 114/61, 114/283, 352, 353, 354; 280/12.11

[56] References Cited

U.S. PATENT DOCUMENTS

| | | | |
|---|---|---|---|
| 2,959,795 | 11/1960 | Leung | 441/73 |
| 3,711,879 | 1/1973 | Siefert | 441/82 |
| 4,079,953 | 3/1978 | Howarth, Jr. | 441/82 |

*Primary Examiner*—Jesus D. Sotelo

*Attorney, Agent, or Firm*—Blodgett & Blodgett

[57] ABSTRACT

A rescue device for use by an operator on an ice surface and in water. The device has a pair of elongated buoyant bodies which are pivotally connected for movement relative to each other between an operative position in which the bodies are spaced and lie in the same horizontal plane to a folded or inoperative position in which the bottom surfaces of the bodies are abutting. A handle is connected to each body.

21 Claims, 7 Drawing Sheets 20
12
50
60
70
62
38
32
46
64
80
74
86
78
68
82
84
58
52
54
56
39
40
36
34
30
28
76
72
74
66
65

108
110
90
94
116
106
92
104
98
100
96
112
114
102

FIG. 8
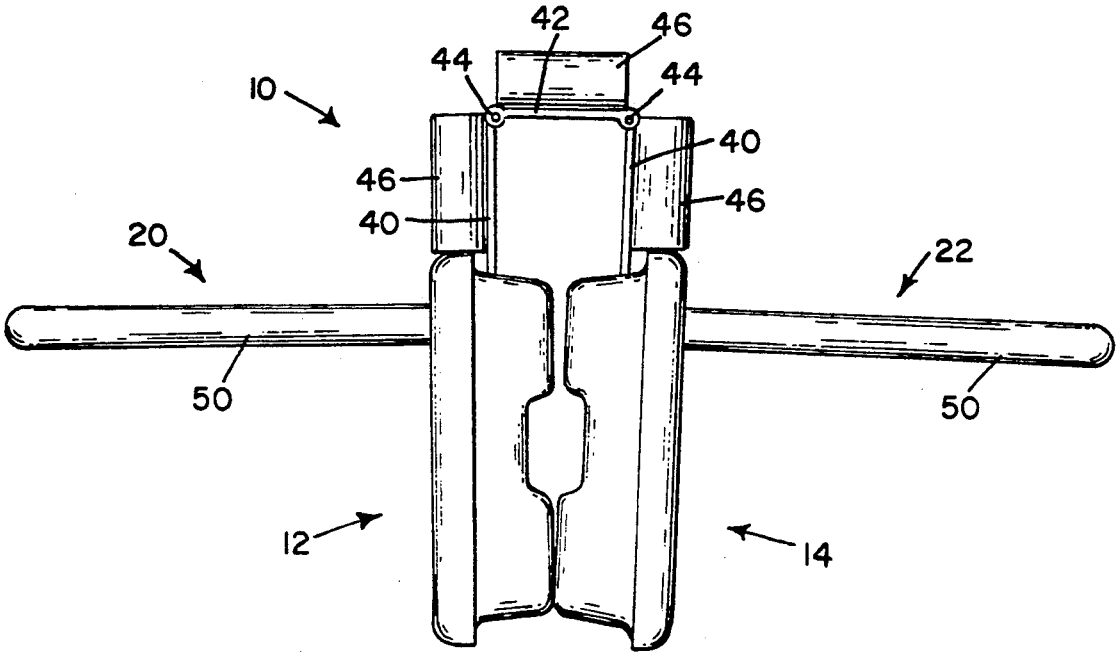
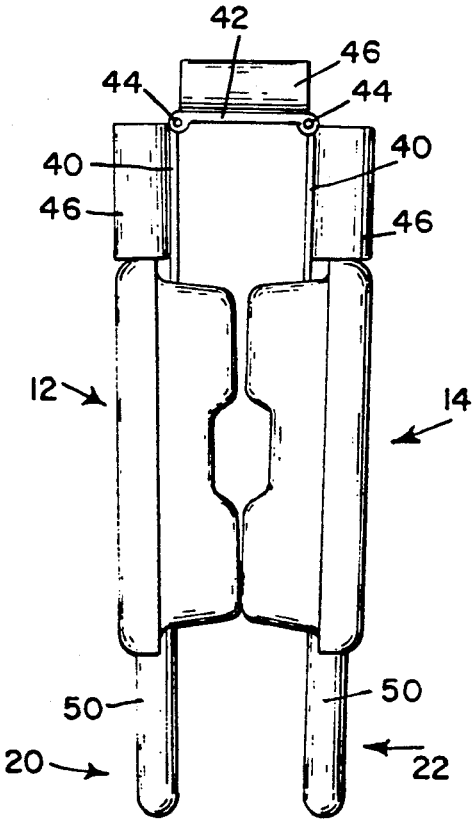
FIG. 9

AQUATIC RESCUE DEVICE

BACKGROUND OF THE INVENTION

The present invention relates generally to a device for use in rescuing a drowning victim who has broken through thin ice or is floundering in open water. The invention is particularly directed to a rescue device for ice and water rescue situations which enables a rescuer to reach a drowning victim who has fallen through the ice or is in distress in an open body water and to secure the victim for transport to a safe location.

Many types of buoyant rescue devices have been developed for enabling a rescuer to reach a drowning victim who has either fallen through the ice or is unable to swim in open water. The prior art devices are relatively large sled-like structures which are buoyant and which have relatively large bottom service areas for distributing the weight of the device as well as the weight of the victim and the rescuer over a large supporting area such as an ice surface. Because of its primary purpose, the rescue sled must be bulky and buoyant so as to be supported on thin ice and to float in water. However, the bulkiness of the rescue sled makes it difficult to transport and to store during periods of nonuse. Inflatable rescue devices have also been developed which do not have the disadvantage of being difficult to transport and store. However, the inflatable devices are subject to deflation as a result of tearing on sharp ice, rocks, or broken bottles. The weight of the victim and the rescuer are not spread uniformally and tends to shift so that the device is not as stable as that of the rigid rescue sleds. Also, due to the yieldable nature of the inflatable device, there is a tendency for the victim to roll off the supporting surface of the device. These and other difficulties experienced with the prior art rescue devices have been obviated by the present invention.

It is, therefore, a principle object of the invention to provide a device for ice and water rescue which has the advantages of a rigid rescue sled in terms of stability and resistance to disablement and the advantages of an inflatable rescue device in terms of ease of transporting and convenience of storing.

Another object of the invention is the provision of a device for ice and water rescue which is convertible between a relatively bulky functional state for use in rescue situations to a compact non-functional state for transporting and storage.

A further object of the present invention is the provision of a device for use in ice and water rescue which can be converted easily and quickly between a bulkly functional state and a compact non-functional state.

It is another object for the present invention to provide a device for use in ice and water rescue which includes means for enabling a rescuer to easily and quickly secure a drowning victim to a sled at the initial point of rescue.

A still further object of the invention is the provision of a device for use in ice and water rescue which is easy and convenient to use for rescuing victims in emergency situations and which is capable of a long life of useful service.

With these and other objects in view, as will be apparent to those skilled in the art, the invention resides in the combination of parts set forth in the specification and covered by the claims appended hereto.

SUMMARY OF THE INVENTION

The invention consists of a device for ice and water rescue which has a pair of spaced elongated buoyant main body portions which are connected together by a hinge connector which enables the bodies to selectively occupy a spaced open position for use in a rescue mode and a folded or compact position in which the bodies lie against one another. A handle is fixed to each body so that when the rescue device is in the operative mode, the handle extends above the upper surface of the main body. More specifically, each handle is pivotally connected to its respective main body portion so that when the rescue device is folded into its compact state, the handle is pivoted from operative position in which the handle extends outwardly from the main body to an inoperative position which the handle lies parallel to the main body. The invention also includes a harness mechanism for securing a rescued victim to the rescue device at the point of rescue.

BRIEF DESCRIPTION OF THE DRAWINGS

The character of the invention, however, may be best understood in reference to one of its structural forms, as illustrated by the accompanying drawings, in which:

FIG. 8 is a front elevational view of the rescue device showing the main body portions in a folded or inoperative position, FIG. 9 is a front elevational view of the rescue device showing the main body portions and the handles in folded inoperative positions.

DESCRIPTION OF THE PREFERRED EMBODIMENT

Figure 1:
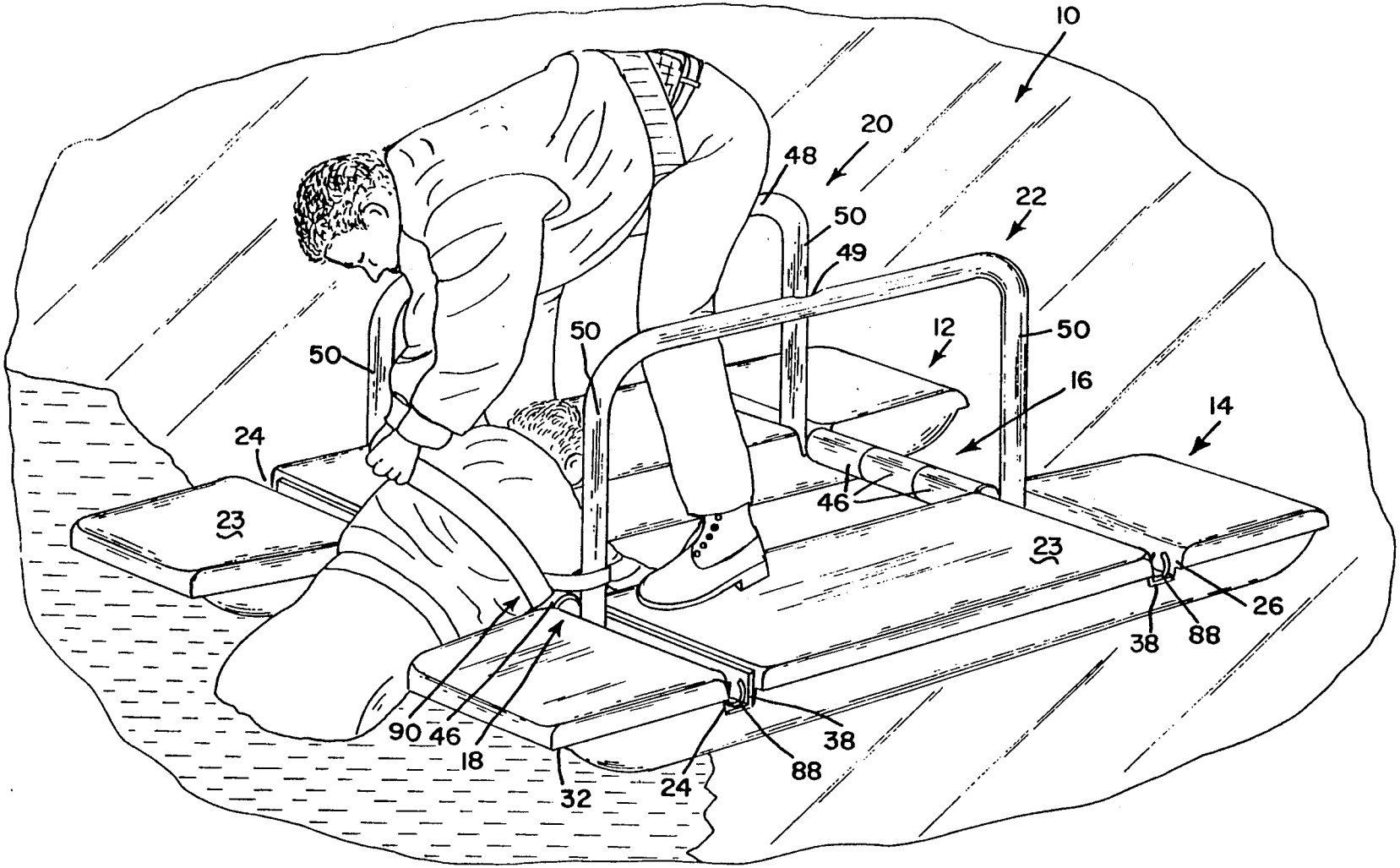
FIG. 1 is a perspective view of a rescue device embodying the principles of the present invention and shown in an operative position as employed in a rescue situation.
Figure 2:
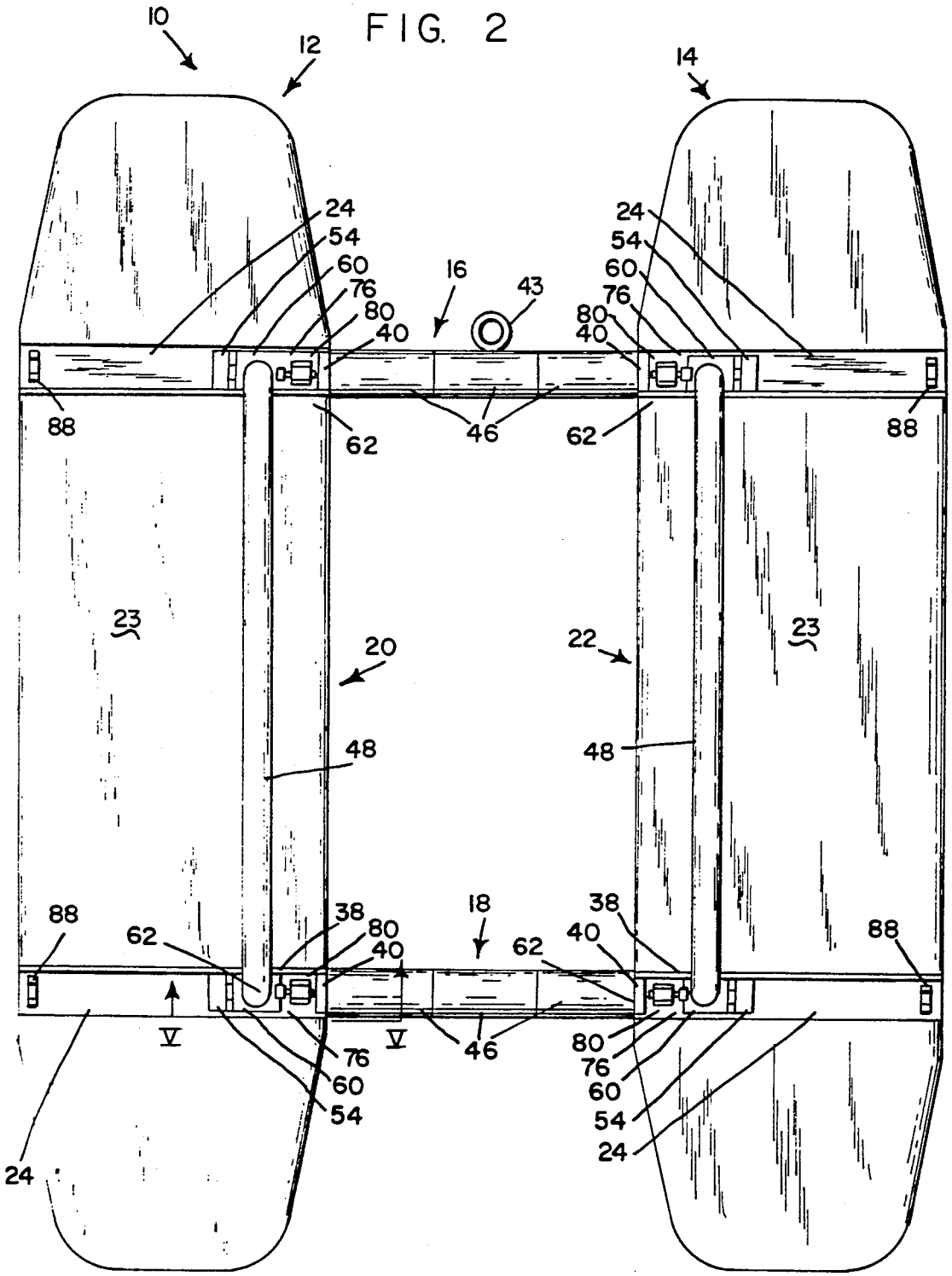
FIG. 2 is a top plan view of the rescue device.

Referring first to FIGS. 1–4 which best show the general features of the present invention, the rescue device of the present invention is generally indicated by the reference numeral 10. The rescue device 10 comprises a pair of spaced buoyant elongated bodies 12 and 14 which are held together in a spaced parallel relationship by a pair of hinged connectors, generally indicated by the reference numerals 16 and 18. A pair of handles, generally indicated by the reference 20 and 22, are pivotally attached to bodies 12 and 14, respectively. Each of the bodies 12 and 14 has an upper flat surface 23 which has a front laterally extending groove 24 and a rear laterally extending groove 26. An outwardly extending lip 32 extends around the entire peripheral side of each of the bodies 12 and 14.

Figure 4:
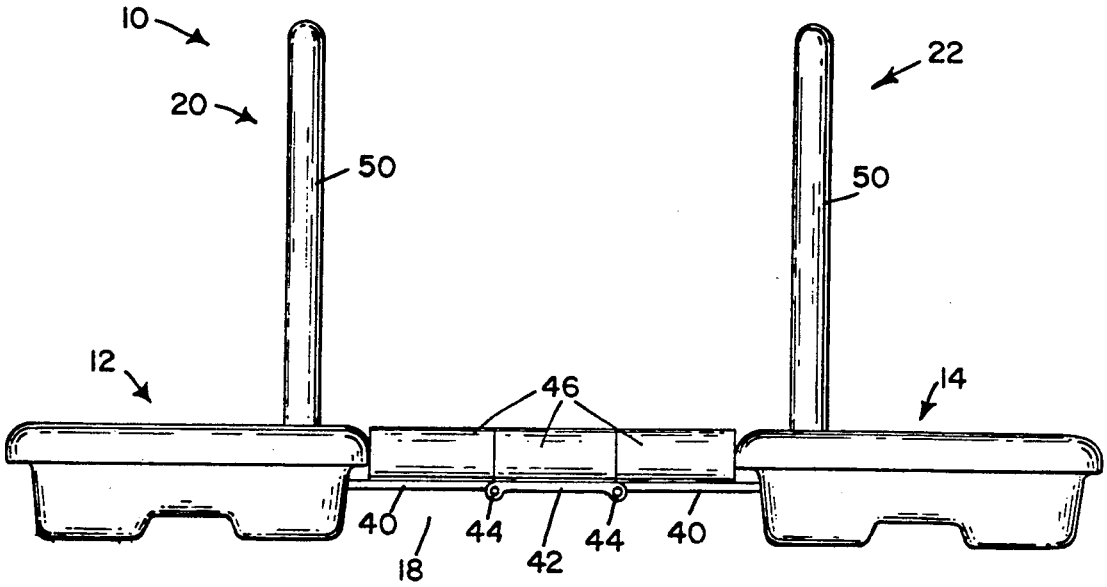
FIG. 4 is front elevational view of the rescue device.
Figure 5:
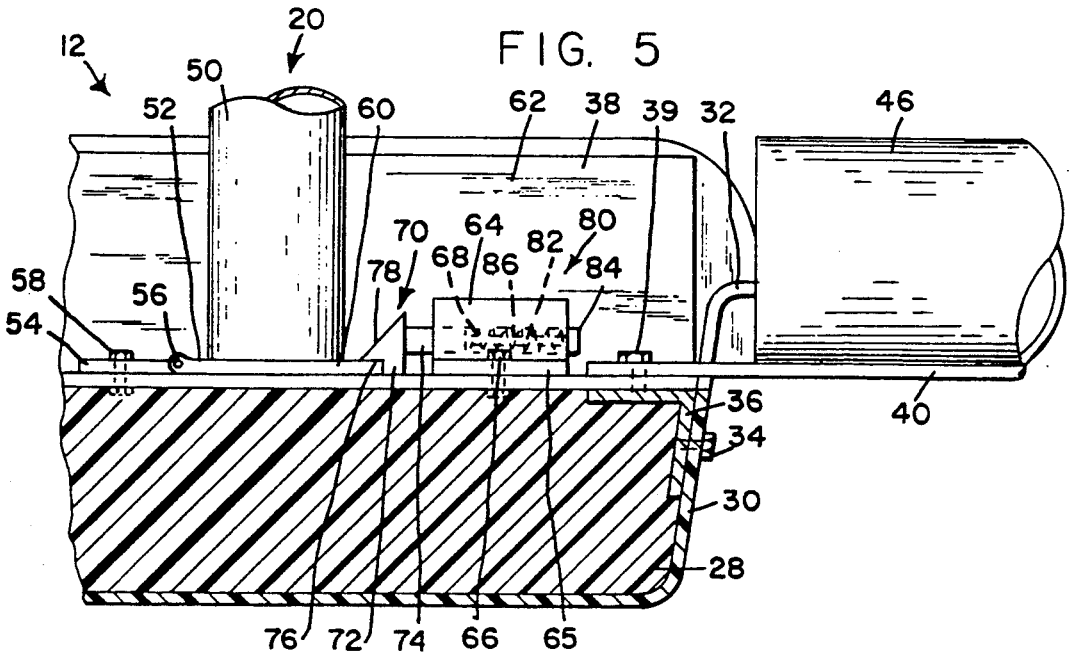
FIG. 5 is a fragmentary vertical cross sectional view taken along the line 5—5 of FIG. 2 and looking in the direction of the arrows, and showing one of the handles of the rescue device in a locked position.

Referring particularly to FIG. 5, each of the bodies 12 and 14 comprises a core 28 of structural foam thermoplastic material and an outer casing 30 of solid thermoplastic material which covers the lower portion of the body up to and including the lip 32. An L-shaped bracket 36 is embedded in the structural foam core 28 beneath each of the groove s 24 and 26 at each end of the groove. The solid plastic casing 30 is fixed to the brackets 36 by self-tapping screws 34. An L-shaped brace 38 is located in each of the grooves 24 and 26 and is fastened to the brackets 36 at each end of the groove by self-tapping screws 39. Referring also to FIG. 4, the hinged connector 18 comprises a pair of end plates 40 which are pivotally connected to a center plate 42 by means of pivot pins 44. Each of the plates 40 and 42 is fixed to a stiffening member 46 which consists of a relatively short cylindrical plastic tube. The outer end of one of the end plates 40 rests on top of the bracket 38 and is fixed to one of the brackets 36 of the elongated body 12 by means of the self-tapping screws 39. The outer end of the other plate 40 is fixed to the L-shaped brace 38 and to the inner bracket 36 of the body 14 by self-tapping screws. A ring 43 is fixed to the center plate 42 of the rear connector 16 enabling a tow line to be attached to the rescue device.

Figure 3:
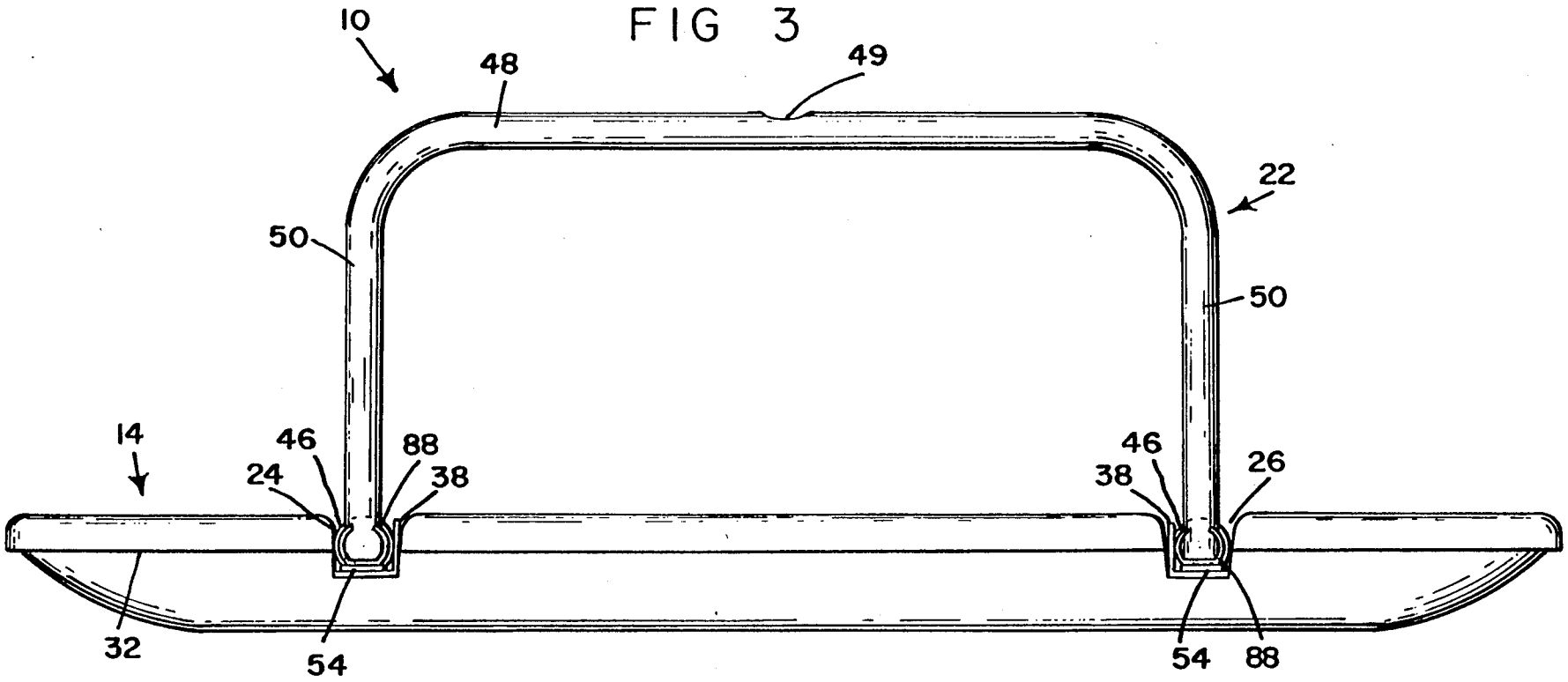
FIG. 3 is a right side elevational view of the rescue device.
Figure 6:
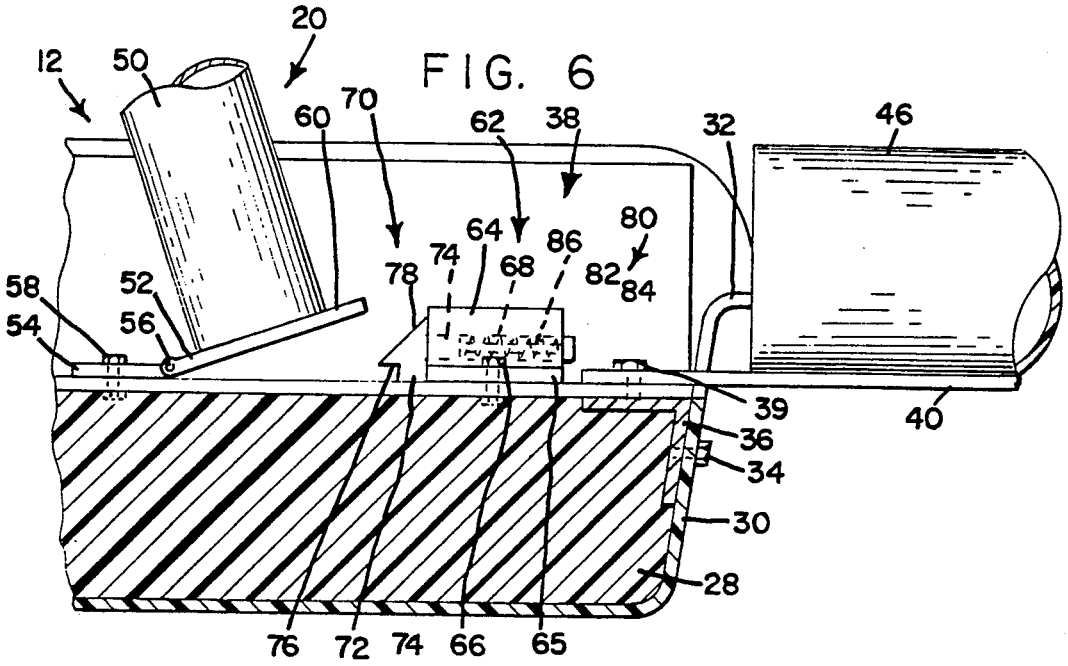
FIG. 6 is a view similar to FIG. 5, showing the handle in the unlocked position.

Referring particularly to FIGS. 1 and 3, each of the handles 20 and 22 comprises a horizontal top portion 48 and a pair of vertical leg portions 50. The horizontal top portion 48 has an upwardly facing notch 49 for a purpose to be described. Each of the handles 20 and 22 is preferably made of a cylindrical tube of thermoplastic material such as polyvinyl chloride. The bottom end of each leg 50 is fixed to a base plate 52 which is pivotally connected to an anchor plate 54 by a pivot pin 56. The anchor plate 54 is fixed to the L-shaped brace 38 by bolts 58. The inner end of the base plate 52 which faces the hinged connector 18 has a projecting lip 60 for engaging a latching mechanism which is generally indicated by the reference numeral 62. The latching mechanism 62 comprises a housing 64 which has a pair of laterally extending flanges 65 for fixing the housing 64 to the L-shaped brace 38 by means of bolts 66. The housing 64 also has a horizontal bore 68. The latching mechanism 62 also comprises a dog which is generally indicated by the reference numeral 70 and a retaining rod which is generally indicated by the reference numeral 80. The dog 70 comprises a head portion 72 which has a downwardly facing notch 76 for engaging the projecting lip 60 and a shank portion 74. The head portion 72 has a cam surface 78 which is slidably mounted within the bore 68. The retaining rod 80 has a shank portion 82 which is threaded into the shank portion 74 and a head portion 84. A spring 86 is also located within the bore 68 and biases the dog 70 away from the housing 64 and into engagement with the projecting lip 60. The inner end of the bore 68 has an opening for receiving the shank portion 82. However, this opening is smaller than the diameter of the spring or the head portion 84 for retaining the spring. Each of the handles 20 and 22 can be unlatched by pushing the head portion 72 of the latch mechanism 62 toward the housing 64 which causes the notch 76 to disengage from the projecting lip 60. This allows the handle to be pivoted about the pivot pin 56 as shown in FIG. 6. The handle can be moved from the operative position, as shown in FIG. 5 in which the legs 50 are vertical, to an inactive position in which the legs 50 extend along the grooves 24 and 26. A spring clip 88 is located in the outer end of each of the notches 24 and 26 for releasably engaging the legs 50 of the handle and for maintaining the handle in the inactive position.

Figure 7:
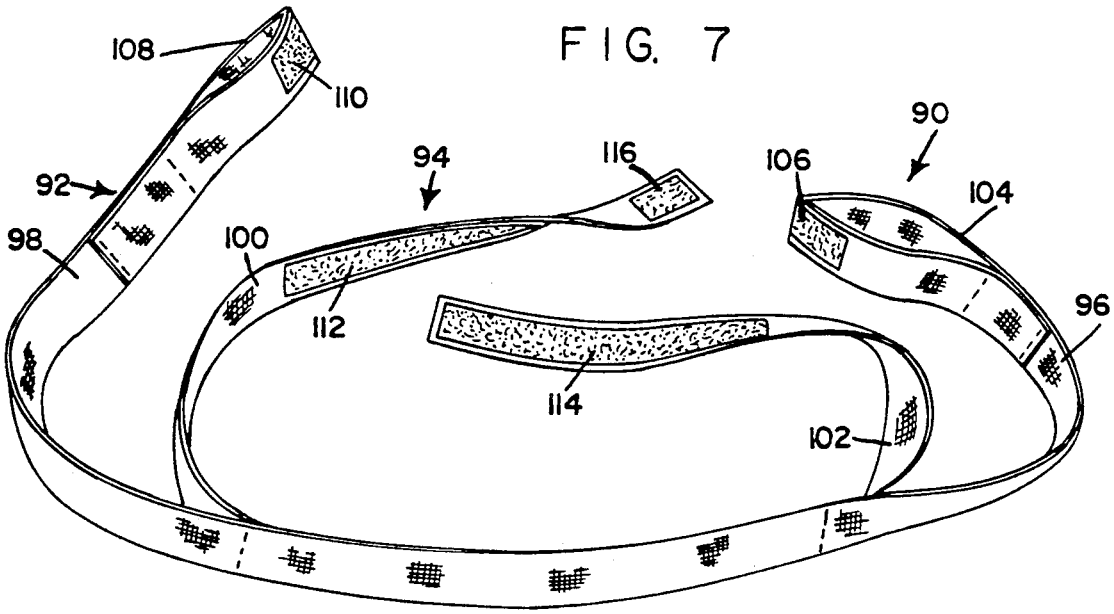
FIG. 7 is a view of a harness mechanism for securing a victim to the rescue device during a rescue operation.

Referring to FIGS. 1, 4 and 7, there is shown a flexible retaining harness which is generally indicated by the reference numeral 90 and comprises a first webbing, generally indicated by the reference numeral 92, and a second webbing which is generally indicated by the reference numeral 94. The webbings 92 and 94 are made of strong woven material. The webbings 92 and 94 are joined, i.e. by sewing, along a midpoint section of both webbings so that four distinct straps are formed. First and second straps 96 and 98, respectively, are formed from the webbing 92. Third and fourth straps 100 and 102, respectively, are formed from the webbing 94. The free end of the first strap 96 is formed into a loop 104 which encircles the forward leg 50 of the handle 22. The strap 96 also contains a fastening element 106. The free end of the second strap 98 is formed into a loop 108 which encircles the forward leg 50 of the handle 20. The strap 98 also contains a fastening element 110. The third strap 100 has a first primary fastening element 112 on one side of the strap and a secondary fastening element 116 on the opposite side of the strap. The fourth strap 102 has a primary second fastening element on one side of the strap and a secondary fastening element 118 on the opposite side of the strap. The second primary fastening element 114 is complementary to the primary first fastening element 112 so that when the fastening elements 112 and 114 are joined, the straps 100 and 102 form a loop for encircling and retaining a victim as shown in FIG. 1. The secondary fastening elements 116 and 118 are complementary to the fastening elements 106 and 110 for securing the ends of the straps 110 and 102 to the ends of the straps 96 and 98 so that the straps are secured during periods of nonuse. The preferred fastening means for the present invention consist of a textile hook and loop fastening material which is sewn or otherwise secured to the straps, as for example, a material which is sold under the trademark VELCRO. The fastening material 112 and 114 is of sufficient length to enable loops of varying sizes to be formed to accommodate small and large victims.

Figure 10:
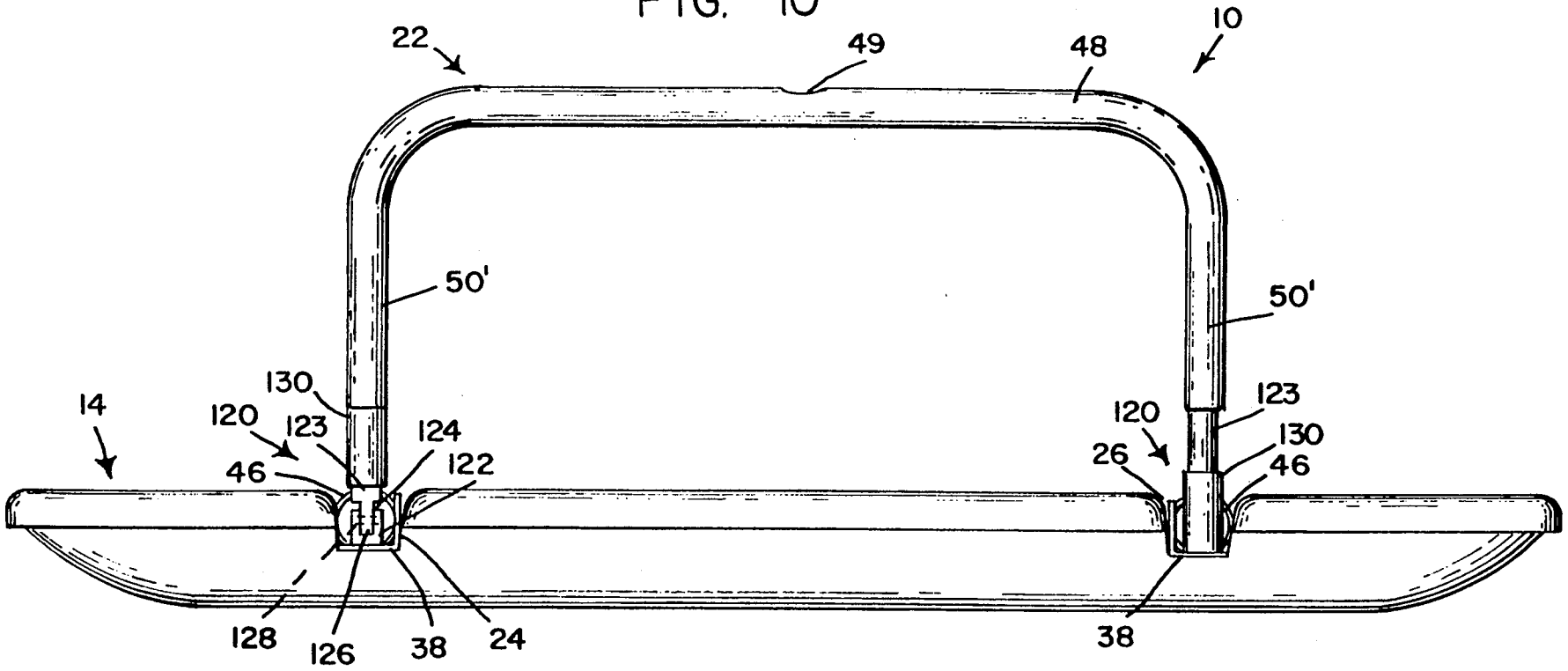
FIG. 10 is a side elevational view of the rescue device embodying the principles of the present invention and which is provided with a modified latching mechanism for the handles.

Referring particularly to FIG. 10, there is shown a modified latching mechanism which is generally indicated by the reference numeral 120. Modified latching mechanism 120 includes a modification of the vertical legs of the handles as well as the means for anchoring the legs to the buoyant elongated bodies. The modified vertical leg of each handle is indicated by the reference numeral 50′ and comprises a lower portion 123 which has a reduced diameter and a narrow bottom end 126 which fits into a vertical slot 124 of a post 122 which is fixed to the L-shaped brace 38. The leg 50 is pivotally connected to the post 122 by a horizontal pin 128 which extends through aligned horizontal apertures in the post 122 and the bottom end 126 of the vertical leg 50′. This enables the handle 22 to pivot from its upright position as shown in FIG. 10 to a horizontal position, wherein the legs 50′ lie in the grooves 24 and 26. The handles 20 and 22 are locked in the upright position by sleeves 130 which are slidably mounted on the small diameter portions 123 of the legs 50′. Each sleeve 130 is slidable from an upper position as shown in the left hand side of FIG. 10, wherein the sleeve is located above the post 122, to a lower position in which the sleeve 130 encircles the post 122 and the bottom portion 126 of the leg 50' as shown in the right hand side of FIG. 10. The sleeve 130 prevents the leg 50' from pivoting relative to the post 122. The sleeves 130 are free sliding so that when the handles 20 and 22 are moved from their inoperative horizontal positions to their active vertical positions, the sleeves 130 fall by gravity from their upper positions as shown at the left hand side of FIG. 10 to their lower positions as shown at the right side of FIG. 10. This automatically locks the handles 20 and 22 in their upright or active positions. Each handle is moved from its active upright position to its horizontal inactive position by sliding the sleeves 130 to their upper positions and pivoting the handle relative to the post 122.

Referring particularly to FIGS. 8 and 9, the rescue device 10 of the present invention is converted from its functional or operative state as shown in FIG. 4 to its collapsed or compact state for transporting and storage as shown in FIG. 9 by swinging the bottoms of the bodies 14 and 12 toward each other about the pivot pins 44 as shown in FIG. 8. This represents the first step of the folding or compacting procedure. The second step of the compacting procedure is accomplished by unlatching the bottom ends of the handles 20 and 22 and pivoting the handles relative to their respective elongated bodies so that the leg portions 50 of the handles extend along the grooves 24 and 26 as shown in FIG. 9. The rescue device 10 is converted from the compact state on FIG. 9 to the expanded or operational state as shown in FIG. 4 by reversing steps 1 and 2 described above.

The rescue device 10 is utilized for a rescue operation when it is in the fully opened or expanded operational state as shown in FIG. 1, wherein the elongated bodies 12 and 14 lie in the same horizontal plane and the handles 20 and 22 extend upwardly from the bodies in spaced vertical planes. If, for example, a victim is to be rescued from a hole in thin ice, the rescue device is placed on the ice so that the bodies 12 and 14 rest on the surface of the ice near the shore. The rescue device 10 is then advanced toward the victim by the rescuer. This is accomplished by grasping the handles 20 and 22 so that most of the rescuer's weight is transferred to the bodies 12 and 14 which extend over a relatively large surface area on the ice, while the rescuer's feet contact the ice in the space between the elongated bodies 12 and 14. This enables the rescuer to push or walk on the surface of the ice to advance the rescue device toward the victim with only enough downward pressure on the ice to create traction but not to cause the ice to break. If possible, a line or rope is tied to the ring 43 of the rescue device prior to advancing along the ice toward the victim and tied to a stationary object such as a tree at the shore. Preferably, the rope will be held by other rescue personnel if they are available. When the rescuer has advanced the rescue device 10 to the edge of the hole in the ice where the victim is located, the rescuer stands on the sled with one foot on each elongated body as shown in FIG. 1 and grabs the victim's hands or clothing and pulls the victim onto the forward hinged connector 18. This automatically positions the victim on top of the mid-portions of the webbing 92 and 94. The straps 100 and 102 are then brought over the victim and fastened together to form a loop which encircles the torso of the victim. This secures the victim to the rescue sled. If possible, depending on the size and condition of the victim, the victim can be pulled further onto the sled by grasping the straps 100 and 102 and pulling the victim upwardly so that the loops 106 and 108 slide along the legs 50 and onto the horizontal top portions 48 of the handles, at least to the notches 49 which help to hold the straps in place. This additional step enables the victim to be pulled almost completely out of the water and shifts a lot of his or her weight toward the center of the sled and secures the victim to the rescue device in a stable position. The rescuer then turns 180° and advances the rescue device towards the shore in the same manner as the rescue device was advanced toward the victim. The rescuer will now be at the opposite end of the sled from the victim so that the combined weight of the victim and rescuer will be relatively evenly distributed between both ends of the rescue device. If additional rescuers are at the shore, the rescue device containing the victim and rescuer will be pulled toward shore by these additional rescuers. If time permits, the rescuer will be wearing a wet suit. This will significantly reduce the risk of exposure to the rescuer if the rescuer has to enter the water to retrieve the victim.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A rescue device for use by an operator on an ice surface and in water, said device comprising:

(a) a first elongated body which is buoyant in water, said first body having a top surface and a bottom surface;

(b) a second elongated body which is buoyant in water, said second body having a top surface and a bottom surface;

(c) at least one connector which is fixed to said first and second elongated bodies, said connector including a hinge which enables said first and second elongated bodies to swing about said hinge relative to one another between an operative position wherein said first and second bodies are parallel to and spaced from one another and said bottom surface are in the same plane to an inoperative position in which said bottom surfaces abut;

(d) a first handle which is connected to said first elongated body and which extends above the top surface of said first elongated body; and (e) a second handle which is connected to said second elongated body and which extends above the top surface of said second elongated body.

2. A rescue device as recited in claim 1, wherein said hinge comprises:

(a) a first plate;

(b) a second plate which is pivotally connected to said first plate;

(c) a first member which is fixed to said first plate; and (d) a second member which is fixed to said second plate and which abuts said first member when said first and second elongated bodies are in said operative position to form a stiffening brace between said elongated bodies and a temporary support for a person being rescued from water.

3. A rescue device as recited in claim 2, wherein each of said first and second members is a cylindrical tube, said first and second members forming a longer composite cylindrical tube when said elongated bodies are in said operative position.

4. A rescue device as recited in claim 1, wherein said connector is a first connector and a second connector which is identical to said first connector is fixed to said elongated bodies and is spaced from said first connector.

5. A rescue device as recited in claim 1, wherein said hinge comprises:

(a) a first plate having an inner end and an outer end which is fixed to said first elongated body;

(b) a second plate having an inner end and an outer end which is fixed to said second elongated body;

(c) a third plate having a first end which is pivotally connected to said first plate and a second end which is pivotally connected to said second plate;

(d) a first stiffening member which is fixed to said first plate;

(e) a second member which is fixed to said second plate; and (f) a third member which is fixed to said third plate, said third member being located between said first and second members abutting each of said first and second members when said first and second elongated bodies are in said operative position form a stiffening brace between said elongated bodies and a temporary support for a person who is being rescued from water.

6. A rescue device as recited in claim 5, wherein each of said first, second and third members is a cylindrical tube, said first, second and third members forming a longer composite cylindrical tube when said elongated bodies are in said operative position.

7. A rescue device as recited in claim 1, wherein each of said first and second handles is pivotally connected to its respective elongated body for movement between an operative position in which the handle extends above and at an angle to the top surface of its respective elongated body to an inoperative position in which the handle abuts the top surface respective elongated body, said sled further comprising locking means for releasably locking each of said handles in its operative position.

8. A rescue device as recited in claim 7, wherein the pivotal connection of each of said handles comprises a lower projection which is fixed to its respective elongated body and an upper projection which is fixed to the handle and which is pivotally connected to said lower projection, for pivoting about a horizontal axis, said upper and lower projections being aligned along a vertical axis when the handle is in its operative position, said locking means comprising a sleeve which is slidably mounted on said upper projection for movement along said vertical axis between upper non-locking position above the lower projection to a locking position in which the sleeve covers at least a portion of each of said upper and lower projections.

9. A rescue device as recited in claim 7, wherein the top surface of each of said elongated bodies has a groove for receiving its corresponding handle when the handle is in its inoperative position.

10. A rescue device as recited in claim 7, wherein said locking means is an automatic latching mechanism for each of said handles, each of said latching mechanisms being actuated to a locking relationship with its respective handle by the handle as the handle moves from its inoperative position to its operative position.

11. A rescue device as recited in claim 10, wherein each of said latching mechanisms comprises:

(a) a projecting element which is fixed to the handle and which has an upwardly facing surface; and (b) a dog which has a downwardly facing surface, said dog being mounted on said device for movement between a locking position in which said downwardly facing surface abuts said upwardly facing surface when the handle is in its operative position and a release position in which said downwardly facing surface is out of vertical alignment with said upwardly facing surface, said dog being biased toward said locking position, said dog having a cam surface which is engaged by said projecting element for movement of said dog to its release position during movement of the handle toward its operative position, said cam surface being disengaged by said projecting element when the handle is at its operative position to allow said dog to move to its locking position in locking engagement with said projecting element.

12. A rescue device as recited in claim 1, wherein each of said elongated bodies comprises:

(a) an interior core of cellular thermoplastic material; and (b) an exterior skin of said thermoplastic material.

13. A rescue device as recited in claim 1, further comprising a flexible retaining harness which is fixed to said device.

14. A rescue device as recited in claim 13, wherein said harness comprises:

(a) a first strap having a first end which is connected to one of said handles;

(b) a second strap having a first end which is connected to the other of said handles and a second end which is connected to said the second end of said first strap, (c) a third strap having a first end which is fixed relative to said first and second straps and a second free end which has a first fastening element;

(d) a fourth strap having a first end which is fixed relative to said first, second and third straps and a second free end which has a second fastening element which is complementary to said first fastening element so that when said first and second fastening elements are fastened together, the third and fourth straps form a loop.

15. A rescue device as recited in claim 14, wherein the second end of at least one of said third and fourth straps has a first additional fastening element and the first end of at least one of said first and second straps has a second fastening element which is complementary with said additional fastening element for securing said third and fourth straps during periods of nonuse.

16. A rescue device as recited in claim 14, wherein said first and second straps are opposite free ends of first length of webbing and said third and fourth straps are opposite free ends of a second length of webbing which is fixed to said first length of webbing.

17. A rescue device as recited in claim 14, wherein the first end of each of said first and second straps is formed into a loop which encircles one of said handles.

18. A rescue device as recited in claim 14, wherein each of said handles has a first portion which extends vertically from its corresponding elongated body to an upper end and second portion which extends horizontally from the upper end of the first portion, and wherein the ends of said first strap are slidably mounted on said handles for movement between a lower position adjacent the top surfaces of the elongated bodies to an upper position on the horizontal second portions of the handles, thereby enables a rescue victim to be raised from a lower position adjacent the elongated bodies to an upper position above the top surfaces of the elongated bodies.

19. A rescue device as recited in claim 18, wherein the second portion of each handle has retaining means for maintaining the first strap in its upper position.

20. A rescue device as recited in claim 19, wherein said retaining means is a notch in the second portion of each handle.

21. A rescue device as recited in claim 1, wherein each of said handles has an inverted U-shaped configuration which includes a pair of vertical portions which are connected to the corresponding elongated body and a horizontal portion which is connecting to the two vertical portions.

* * * * *